US012286848B2

(12) United States Patent
Machocki et al.

(10) Patent No.: US 12,286,848 B2
(45) Date of Patent: Apr. 29, 2025

(54) SYSTEM AND METHOD TO DETECT AND MEASURE FLUID FLOW IN THE RETURN LINE DURING DRILLING ACTIVITIES

(71) Applicant: SAUDI ARABIAN OIL COMPANY, Dhahran (SA)

(72) Inventors: Krzysztof Karol Machocki, Aberdeen (GB); Sakethraman Mahalingam, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/455,543

(22) Filed: Aug. 24, 2023

(65) Prior Publication Data

US 2025/0067133 A1 Feb. 27, 2025

(51) Int. Cl.
*E21B 21/08* (2006.01)
*E21B 21/06* (2006.01)

(52) U.S. Cl.
CPC ..... *E21B 21/08* (2013.01); *E21B 21/065* (2013.01)

(58) Field of Classification Search
CPC ..... E21B 21/08; E21B 21/065
See application file for complete search history.

(56) References Cited

U.S. PATENT DOCUMENTS 4,430,892 A 2/1984 Owings
5,063,776 A * 11/1991 Zanker ..... G01F 1/002 73/152.21
6,257,354 B1 7/2001 Schrader et al.
6,820,702 B2 11/2004 Niedermayr et al.
9,388,650 B2 7/2016 Leuchtenberg
2016/0146653 A1* 5/2016 Skelding ..... E21B 21/01 73/861.01
2017/0101834 A1* 4/2017 Henriksen ..... G01P 5/005
2018/0038179 A1* 2/2018 Canty ..... G06T 7/248
2018/0187498 A1* 7/2018 Sanchez Soto ..... E21B 21/08
(Continued)

OTHER PUBLICATIONS

Loeppke, Glen E. et al., "Development and Evaluation of a Meter for Measuring Return Line Fluid Flow Rates During Drilling"; Sandia Report; Report No. SAND-91-2607; pp. ii-114; Jun. 1992 (131 pages).

(Continued)

*Primary Examiner* — Nicole Coy
*Assistant Examiner* — Nicholas D Wlodarski
(74) *Attorney, Agent, or Firm* — Osha Bergman Watanabe & Burton LLP

(57) ABSTRACT

A system for monitoring fluid flow conditions on a return flow line including a return flow line in fluid communication with a wellbore, a shaker, and a header box. The system includes a contactless flow sensor facing an interior of the header box or an outlet of the return flow line, a data gathering and analyzing unit coupled to the contactless flow sensor, and a control panel to display data and notify when hazardous conditions occur. A method for monitoring fluid flow conditions on a return flow line including flowing a drilling mud into the header box through the return flow line and monitoring the height of the drilling mud in the header box and/or return flow line to determine the fluid level using the contactless flow sensor. The fluid level is used to determine a fluid flow rate and indicate a current operational or a hazardous operational status.

19 Claims, 6 Drawing Sheets

(56) References Cited

U.S. PATENT DOCUMENTS

| | | | | |
|---|---|---|---|---|
| 2019/0309589 | A1* | 10/2019 | Torjussen | G01F 1/72 |
| 2019/0368287 | A1* | 12/2019 | Shekhar | G01F 1/663 |
| 2020/0318464 | A1 | 10/2020 | Atchison et al. | |
| 2020/0386066 | A1 | 12/2020 | Brana et al. | |
| 2021/0293103 | A1* | 9/2021 | Olsen | E21B 47/09 |
| 2023/0392460 | A1* | 12/2023 | Agu | G01N 15/1459 |

OTHER PUBLICATIONS

International Search Report and Written Opinion issued in corresponding International Application No. PCT/US2024/042081, dated Nov. 21, 2024 (15 pages).

* cited by examiner

SYSTEM AND METHOD TO DETECT AND MEASURE FLUID FLOW IN THE RETURN LINE DURING DRILLING ACTIVITIES

BACKGROUND

Drilling activities involve complex systems that can result in failure modes leading to large fluid losses, high costs, or, in the case of a blowout, significant danger to personnel and the facilities. Mud flow rate variation can provide an early indication of potential problems in later stages of drilling activities. Generally, mud delivers a hydrostatic pressure barrier on the annular side to prevent any influxes or hole instability. Without accurate measurements of the mud flow rate on the annular side, it is challenging to detect early signals of well control events (including influxes), loss circulation problems, or hole instability. With accurate flow measurements and pump speed information, fractured zones can be identified to prevent loss of drilling mud into the formation to reduce unnecessary expenses. Accordingly, there exists a need to mitigate these risks by closely monitoring the fluid flow and pump speed in the return flow line in a drilling system to provide data on the mud flow rate on the annual side. This data may be interpreted to provide immediate notification if any abnormal conditions arise.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for monitoring fluid flow conditions on a return flow line including a return flow line in fluid communication with a wellbore, a shaker with multiple screens to filter a fluid, and a header box coupled to the shaker and in fluid communication with the return flow line. A contactless flow sensor faces an interior of the header box or the outlet of the return flow line near the header box. The contactless flow sensor provides data to determine a fluid flow rate based on the fluid level in the header box, the return flow line, or both. A data gathering and analyzing unit is coupled to the contactless flow sensor, which interprets the data from the flow sensor and determines a current operational status or a hazardous operational status based on the fluid flow rate and a mud pump speed. The control panel is coupled to the data gathering and analyzing unit and contains a human machine interface to display the fluid flow rate, the mud pump speed, and the current operational status or the hazardous operational status. The control panel also contains notification instruments to activate based on the hazardous operational status.

In another aspect, embodiments disclosed herein relate to a method for monitoring fluid flow conditions including flowing the drilling mud into the header box through the return flow line and monitoring a height of the drilling mud in the header box, return flow line, or both using a contactless flow sensor. The height of the drilling mud is utilized to determine a fluid level and a current operational status or hazardous operational status based on a fluid flow rate calculated from the fluid level data.

Other aspects and advantages of the claimed subject matter will be apparent from the following description and the appended claims.

DETAILED DESCRIPTION

In one aspect, embodiments disclosed herein relate to a system for monitoring fluid flow conditions on a return flow line carrying drilling mud during drilling activities. Use of the monitoring system provides an improved, real-time data measurement to communicate and interpret flow rates of drilling mud and pump speeds to determine a system operational status that may trigger visual and auditory alarms in the case of probable failure modes.

During standard drilling activities, mud is pumped through a drill string to aid in the drilling of a wellbore into the earth and to cool and lubricate the drilling equipment. The mud is in a closed loop system, where the mud flows into the drill string into the reservoir and returns to the surface. The mud returns to the surface through the wellbore annulus that is in fluid communication with a return flow line. The return flow line is in fluid communication with a header box that distributes the mud through flow gates and is coupled to one or more shakers. The flow gates may be configured to control flow between the header box and the shaker. The shakers include one or more screens configured to filter out solids from the mud that may have reached the mud in the reservoir. The shakers flow the filtered mud into a mud pit where it is pumped out of and circulated back to go into the reservoir through the drill string in the closed loop system. The mud flow rate should stay constant throughout the process during standard operations. However, different, expected conditions outside of standard drilling may impact the flow rate of the mud. Examples of expected conditions include maintenance activities. This can cause confusion that makes simple flow rate monitoring ineffective in identifying process conditions and upsets. Accordingly, there exists a need for a system that can identify the flow rate of the return line and, based on the combination of that flow rate data and other conditions of the system, can distinguish the difference between standard process conditions and process upsets to provide insight into drilling activities and prevent system failures.

Figure 1:
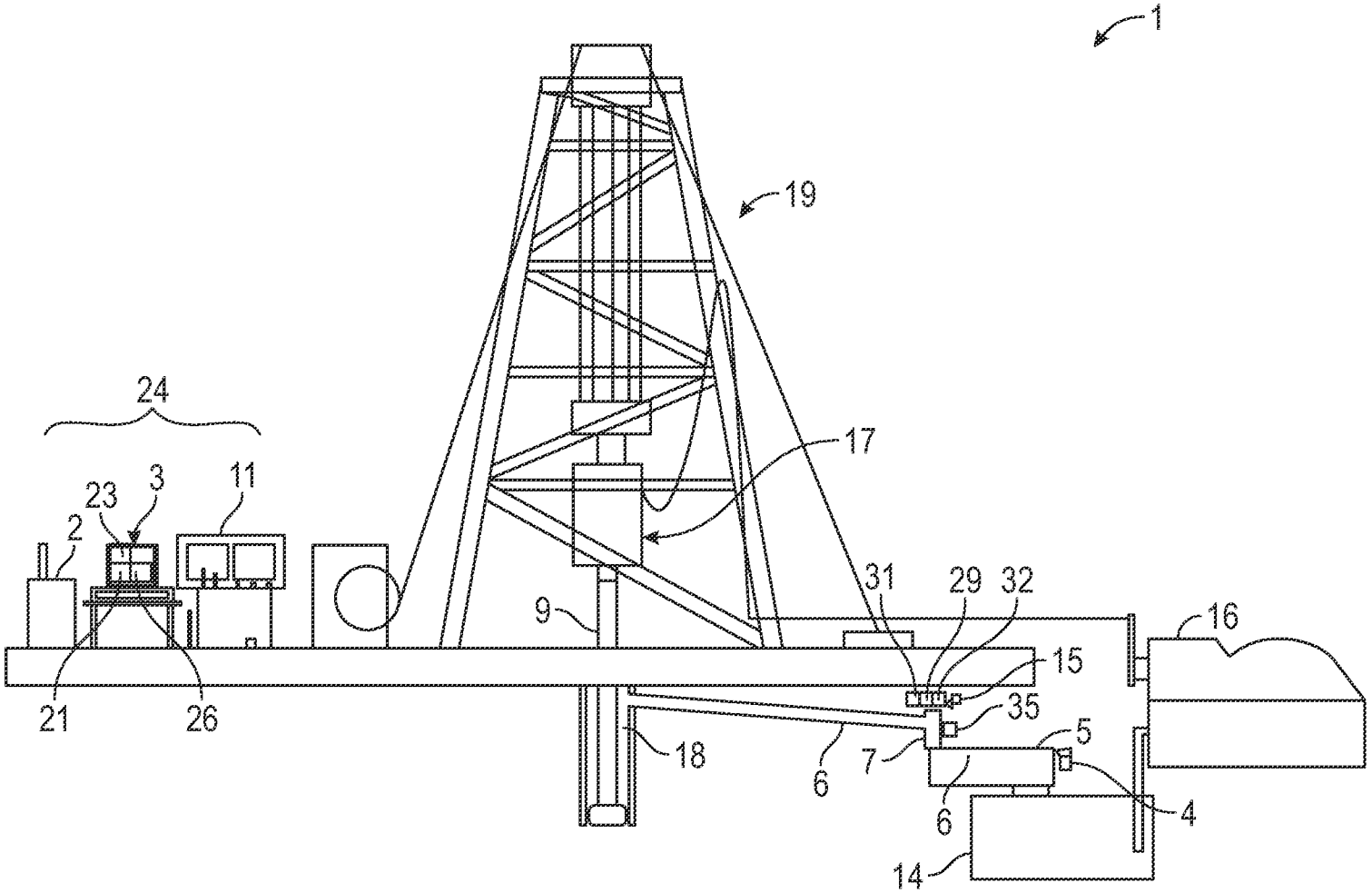
FIG. 1 shows a diagram of an overview of a system in accordance with one or more embodiments.

FIG. 1 show an overview of a system for monitoring fluid flow disposed in a field setting. The field setting may include various equipment and/or components intrinsic to standard oil activities including, for example: a drilling rig 19, a top drive 17, a drill string 9, a wellbore annulus 18, mud pits 14, a drilling console 11, and mud pumps 16. In accordance with one or more embodiments of the present application, the system for monitoring fluid flow may include one or more shakers 5, a header box 7, a return flow line 6 extending from the wellbore annulus 18 to the header box 7, an area sensor 4, one or more contactless flow sensors 15, a data gathering and analyzing unit 2, and a control panel 3 containing an human machine interface (HMI) 21, a visual notification instrument 23, and an auditory notification instrument 26, as shown in FIG. 1. The data gathering and analyzing unit 2 may be located at a surface of the well and in a safe area 24. A safe area 24 is an area a distance away from the drilling location that is unlikely to be damaged by moisture or physical hazards that may occur from standard operations and typical process upsets.

In accordance with one or more embodiments, the system includes at least one contactless flow sensor 15 and may additionally include one or more contact flow sensors 10 configured to determine a fluid level and/or a flow rate of the fluid (e.g., mud). The contactless 15 and contact flow sensors 10 may be wired, wireless, or both. Contactless sensors may use a variety of different technologies, including cameras, infrared sensors, light detection and ranging sensors (LIDAR), ultrasonic sensors, magnetic sensors, microphones sensing sounds from the fluid movement through the pipe including the sound of the fluid when it drops at an exit of the open-ended pipe, and capacitive sensors, to gather flow rate data without physically contacting the fluid itself. For example, a contactless sensor 15, such as a camera sensor, may identify a height of the fluid in the return flow line and/or a header box to calculate a fluid level and a flow rate. When using an infrared sensor, the infrared sensor may detect the presence of objects without physical contact using temperature. When using a LIDAR sensor, the LIDAR sensor may detect a distance between a fluid level in the header box and the LIDAR sensor. A LIDAR sensor may be installed at a predetermined angle above the open-ended pipe of the return flow line to detect fluid changes based on a height of the fluid and based on a width and height of the fluid at the exit of the open-ended pipe. A LIDAR sensor may also be mounted at a distance from the return flow line to map the flowing fluid and detect the fluid changes including no flow and minimum flow conditions. An ultrasonic sensor may use sound waves to detect a presence of fluid and measure the fluid level in the header box. A magnetic sensor may determine if a fluid is or is not flowing, using additional magnetic particles that are introduced on top of the fluid. A capacitive sensor may measure changes in electric fields and detect a fluid level in the header box. In some embodiments, multiple contactless flow sensors 15 may track fluid flow along a flow line to estimate the flow rate of the fluid. The contactless sensors 15 may be mounted on any surface in close proximity to the system, allowing the sensor to be directed at or face the return flow line outlet or the header box.

Still referring to FIG. 1, the system may further include one or more of a self-cleaning device 29, a dye sprayer 35, a light source 32, and reference guides to assist in visibility of the fluid by the contactless sensor(s) 15. For example, the self-cleaning device 29 may spray a cleaning fluid onto the contactless sensor 15 and may be configured to communicate a self-cleaning status for the system to the data gathering and analyzing unit 2. The self-cleaning device 29 may use, for example, a high-speed pressurized liquid or air to clean the sensors to remove residue that may be caused by a color of the fluid or contaminants in the fluids that may adhere to the sensors that may decrease the accuracy of the sensor over time. In some embodiments, there may be multiple self-cleaning devices 29 to provide a cleaning mechanism for each, or some, of the contactless flow sensors 15. The self-cleaning device 29 may include a timer or be triggered by specific system activities. For example, self-cleaning of the contactless sensor(s) 15 may occur during start up conditions when no flow is expected or during drilling at specific flow rates. The self-cleaning device 29 may be triggered based on dirt detection on the contactless sensor 15 itself. The self-cleaning device 29 may be triggered based on a recalibration label 6 located near the shakers. The recalibration label 6 is a label adhered to a surface within the view of the camera that acts as a comparison standard to ensure that the camera is calibrated properly. When the contactless sensor, in this case, a camera, is unable to clearly read the recalibration label 6, it will trigger a cleaning of the recalibration level 6. If the camera continues to be unable to clearly read the recalibration label 6, this inability to take a reading will trigger the self-cleaning device 29 to clean the contactless sensor 15. During this operation, a control panel 3 will display a self-cleaning status.

The system may further include a dye sprayer 35 to improve visibility of the fluid to improve accuracy of the contactless sensor(s) 15. The dye sprayer 35 may be coupled to the header box 7 and directed towards an interior of the header box 7 to spray a dye on the fluid in the header box 7 and improve camera visibility of a mud level. In embodiments in which the system includes a dye sprayer 35, the dye sprayer 35 is configured to spray a reflective dye onto a top surface of the fluid in the header box 7 to improve camera visibility of a mud level. The dye will float on top of the fluid. Common dyes include fluorescein, rhodamine WT, and methylene blue, though others may be used. Fluorescein is a water-soluble dye that may be easily visualized using a UV lamp. Rhodamine WT is a water-soluble dye that is often used to visualize flow patterns in rivers and streams, and may be detected at low concentrations. Methylene blue is a dye that may track fluid flow due to its high visibility.

Figure 7:
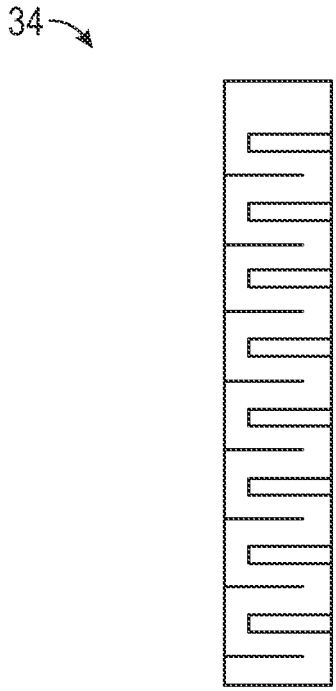
FIG. 7 shows a reference guide in accordance with one or more embodiments.

The contactless sensor(s) 15 of the system for monitoring fluid flow may have one or more lights 32 coupled thereto to improve visibility. These lights 32 may be visible or infrared lights. Further, reference guides 31 for the contactless sensor(s) 15 may be added to any structure in close proximity to the contactless sensor(s) 15. The reference guides 31 may be physically marked onto a surface. In some embodiments, the reference guides 31 may be coupled to the contact sensors 10. Reference guides 31 may be located on a contact sensor 10 to provide a known height to the contactless sensor 15. The contact sensors 10 may be located on or in the return flow line 6 or in the header box 7, while contactless sensors 15 may be directed at the return flow line 6 and header box 7 to capture data. By adhering the reference guides 31 to the contact sensors 10, the reference guides 31 may be within the field of vision of the contactless sensor 15. Reference guides 31 are only useful in the field of vision of the contactless sensor 15. Because of this, the contact sensors 10 are a particularly effective mounting location for the reference guides 31. In some embodiments, reference guides may be lines, points, shapes, or reflective colors on a side and/or bottom of the header box 7 or movable objects within a field of vision of the contactless sensor. For example, FIG. 7 shows one example of a reference guide 34 that provides a reference point for the contactless sensor(s) 15 of the system for monitoring fluid flow. This reference guide 34 improves the accuracy of the contactless sensor(s) 15 by assisting in scaling and comparing the height of the fluid column when viewed with a camera. In some embodiments, the reference guide may provide increased visibility for specific fluid levels.

The system for monitoring fluid flow may also include one or more contact sensors that directly contact the fluid from within the return flow line 6 or header box 7, or may contact the outside of the return flow line 6 or header box 7. In one embodiment, the contact sensors 10 may identify the height of the fluid, to then calculate the fluid level in the return flow line 6 and the header box 7 to determine a flow rate of the fluid in the return flow line 6. Types of applicable contact sensors include flapper valves, temperature array sensors that detect a height of a fluid at least 5° C. warmer than ambient temperature, vibration sensors, ultrasonic sensors, load change detecting sensors, and hydrostatic pressure change detection sensors mounted at different heights inside the flow line.

The system 1 for monitoring fluid flow may include an area sensor 4. The area sensor 4 may be disposed proximate the shaker(s) 5 and configured to monitor maintenance activity proximate the shaker(s) 5 to indicate a maintenance status for the system 1. The area sensor 4 may detect personnel entering an area surrounding the system 1 to identify when maintenance is occurring. In some embodiments, the area sensor 4 may be a gate sensor that recognizes when an access gate is in an opened or closed position to indicate maintenance personnel are in the area. In other embodiments, the area sensor 4 may be a camera that may be utilized in conjunction with a human recognition model to detect maintenance personnel in the area. The area sensor 4 may be a combination of both a gate sensor and a camera. A goal of identifying a maintenance status for the system 1 is to provide an explanation for abnormal process conditions to allow a bypass of the auditory notification instrument 26 and visual notification instrument 23 if maintenance is the cause of the varying process conditions.

The system 1 for monitoring fluid flow may include a data gathering and analyzing unit 2 operatively coupled to the contactless sensor(s) 15 and/or contact sensor(s) 10 to display fluid flow rate, mud pump speed, and a status of the system 1. The data gathering and analyzing unit 2 is preprogrammed to interpret the receiving signals from the various sensors and to select and display a system status. This data communication between contactless sensor(s) 15 and/or contact sensor(s) 10 and the data gathering and analyzing unit 2 may be wired or wireless.

The system 1 for monitoring fluid flow may also include a control panel 3 that may be operatively coupled to the data gathering and analyzing unit 2. The control panel 3 includes a Human Machine Interface (HMI) which may be configured to display the flow rate, mud pump speed, and a status of the system. In one embodiment, the status of the system can be categorized as either current operational status, a hazardous operational status, a maintenance status, or a self-cleaning status. A current operational status describes the state of the system during standard operations, for example, if standard drilling is occurring. A hazardous operational status occurs when flow rate data and pump speed data are out of expected ranges, however, self-cleaning and maintenance are not occurring based on the data communicated from the self-cleaning device and area sensor. This hazardous operational status may occur when a failure mode is anticipated, for example, if fluid losses may be occurring or about to occur. The flow rate data may be displayed in the form of a graph of flow rate against time or fluid level against time. In one embodiment, the control panel may contain an auditory notification instrument 26. In other embodiments, it may contain a visual notification instrument 23. In other embodiments, it may contain both an auditory notification instrument 26 and a visual notification instrument 23. Examples of an auditory notification instrument 26 include a bell and a siren. Examples of a visual notification instrument 23 include a light that may be flashing, solid, colorless, or colored in accordance with one or more embodiments. Both the auditory notification instrument 26 and the visual notification instrument 23 are configured to activate based on a hazardous operational status.

Figure 2:
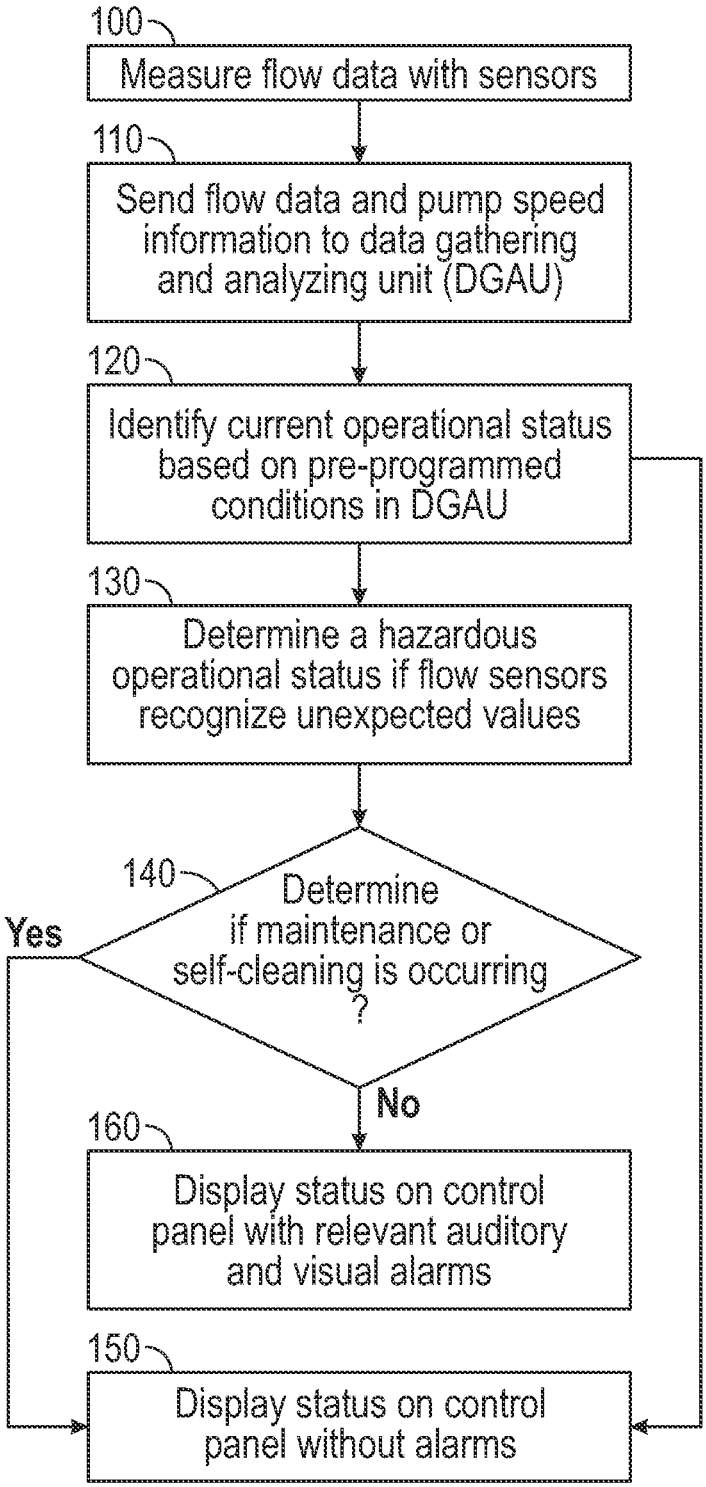
FIG. 2 shows a flow chart of a method according to one or more embodiments.

FIG. 2 shows a flow diagram of a process for monitoring fluid flow conditions in a return flow line 6 (FIG. 1) during drilling activities using a system as disclosed herein in accordance with embodiments of the present application. In FIG. 2, in block 100, the flow sensors (e.g. sensors 10, 15 in FIGS. 1, 3-6) measure flow rate data. This flow rate data may be information from a single sensor or multiple sensors. The flow rate data may be continuous or ordinal data to describe the flow conditions. Continuous data provides a precise flow rate. Ordinal data ranks the flow rate amongst ordered categories, for example, high flow rate, low flow rate, and no flow rate.

The specific process steps of the camera-based contactless sensor 15 (FIG. 1) include an image capture and an image processing step. The image capture may occur at an open end of the return flow line 6 (FIG. 1) or at the header box 7 (FIG. 1). The image may be processed by initially being converted to grayscale. Following this conversion, a known calibrated object may be detected to re-calibrate a distance and position of the camera-based contactless sensor for a more accurate analysis. A Gaussian blur may be applied to reduce noise and smooth the image. Image segmentation, including edge detection, thresholding, and contour detection, may be applied to detect the fluid level in the return flow line 6 (FIG. 1) or the fluid fall from the exit of the return flow line 6 (FIG. 1). From this information, a percentage of the surface area of the open end of the return flow line 6 (FIG. 1) filled with fluid may be calculated to determine flow rate.

In block 110, once the flow rate measurement is obtained from the flow sensors, the flow rate data (including the flow rate measurement) and pump speed data is sent to a data gathering and analyzing unit 2 (FIG. 1) as receiving signals. The pump may continually transmit data on the speed of operation to a drilling rig data acquisition system that communicates this information to the data gathering and analyzing unit 2 (FIG. 1) either wirelessly or through a wired connection. For example, the data gathering and analyzing unit 2 (FIG. 1) may include input data that is representative of threshold fluid flow values that may be compared against the flow rate data received from the flow sensors. In block 150, if the flow rate data follows the expected trends for standard operation, it will display on the control panel without any alarms. However, as shown in block 130, if the data gathering and analyzing unit recognizes unexpected flow rate data from the sensors, the data gathering and analyzing unit 2 (FIG. 1) will determine a hazardous operational status. In block 140, if the flow rate data demonstrates a hazardous operational status, the data gathering and analyzing unit 2 (FIG. 1) will assess if the area sensor 4 (FIG. 1) has triggered or if self-cleaning is occurring. In block 140, if the area sensor 4 (FIG. 1) has triggered, this indicates that maintenance in the area may be a cause for variations in the expected flow rate data from the flow sensors. In block 150, if maintenance is occurring, this maintenance status may display on the control panel 3 (FIG. 1) without alarms. In block 150, if self-cleaning is occurring, this self-cleaning status may display on the control panel 3 (FIG. 1) without alarms. If self-cleaning and maintenance are not occurring, the hazardous operational status will display on the control panel 3 (FIG. 1).

The control panel 3 (FIG. 1) receives information from the data gathering and analyzing unit 2 (FIG. 1). In some embodiments, the control panel contains an auditory notification instrument 26 (FIG. 1) that will alarm when the hazardous operational status is activated, in the absence of maintenance or self-cleaning. In some embodiments, the control panel 3 (FIG. 1) contains a visual notification instrument 23 (FIG. 1), in the form of a light, that will turn on when the hazardous operational status is activated, in the absence of maintenance or self-cleaning. In some embodiments, the light may be flashing, colored, or both. In some embodiments, the control panel 3 (FIG. 1) will contain both an auditory notification instrument 26 (FIG. 1) and a visual notification instrument 23 (FIG. 1).

Figure 3:
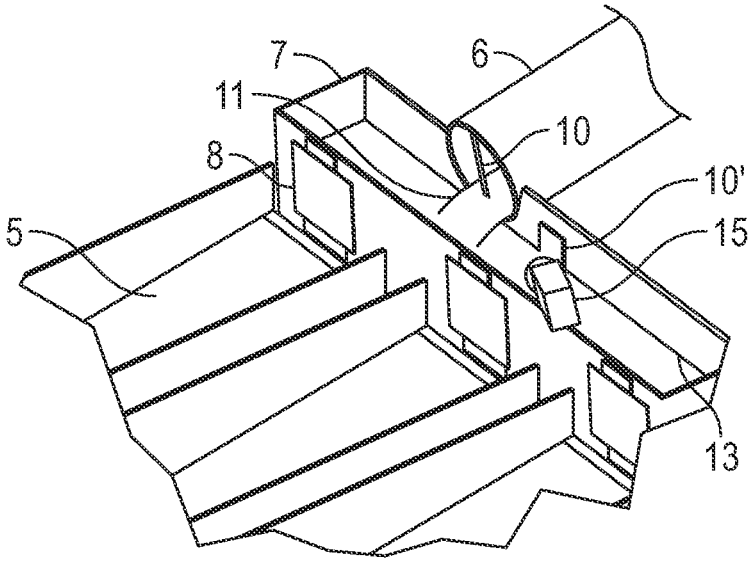
FIG. 3 shows a close view of certain features of a system for monitoring fluid flow conditions during standard drilling flow in accordance with one or more embodiments.
Figure 4:
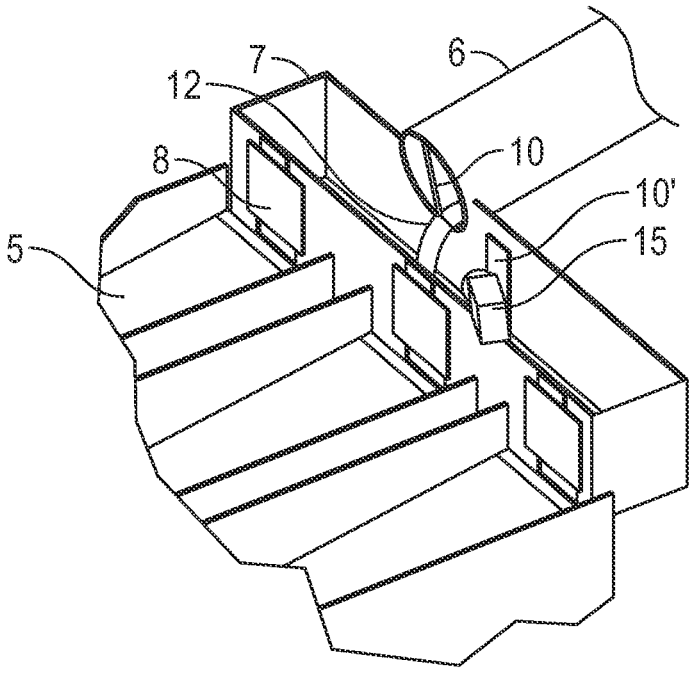
FIG. 4 shows a close view of certain features of a system for monitoring fluid flow conditions during minimal flow conditions in accordance with one or more embodiments.
Figure 5:
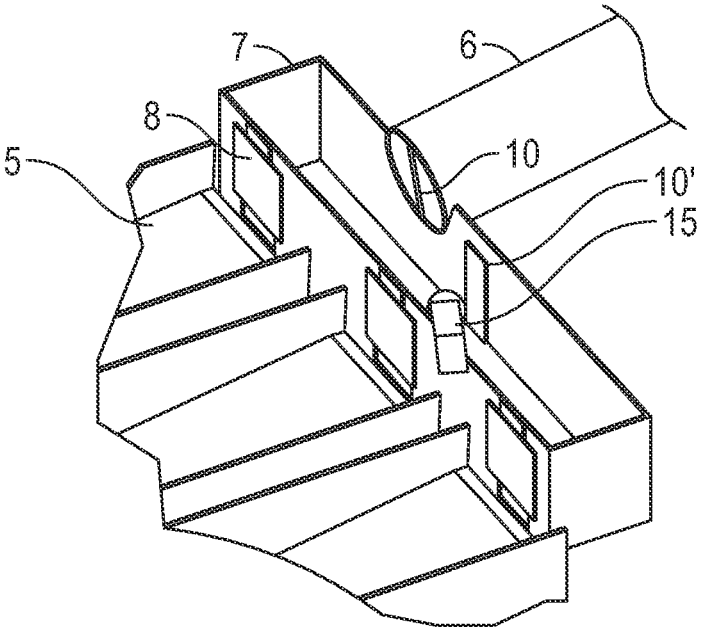
FIG. 5 shows a close view of certain features of a system for monitoring fluid flow conditions during no flow conditions in accordance with one or more embodiments.

FIGS. 3-5 show the close views of certain features of the system 1 (FIG. 1) during different flow conditions including standard, minimal, and no flow, respectively. Referring to FIG. 3, standard flow conditions 11 are demonstrated. FIG. 3 shows the arrangement of certain components of the system 1 (FIG. 1). The return flow line 6 has a single outlet directing fluid into a header box 7. The header box 7 collects the fluid and contains one or more outlets to the shakers 5. The shakers 5 filter out solids from the fluid. The fluid flow between the header box 7 and the shakers 5 is controlled by flow gates 8. The flow gates 8 assist in controlling the fluid flow to each shaker 5 and optionally to a gas meter sensor disposed inside the header box 7, ensuring that some fluid is maintained inside the header box with even fluid distribution across the various shakers. The flow gates may be adjusted to provide a balanced fluid level in each shaker 5 without overloading the shakers 5. In FIG. 3, a contactless sensor 15 is mounted to the header box 7 to identify the flow level inside the header box 7. In other embodiments, the contactless sensor 15 may be mounted on other surfaces in close proximity to the header box 7, allowing the contactless sensor 15 to face the header box 7 fluid level or the return flow line 6 outlet. In some embodiments, a contact sensor 10' is mounted within the header box 7 to measure fluid level in the header box 7. The system 1 (FIG. 1) may contain one or more contact sensors 10, 10' in addition to the contactless sensor 15 to improve the accuracy of the flow rate data. With multiple sensors, the data may be combined to improve the quality of the data due to the advantages of different types of sensors in various conditions. For example, a microphone coupled with a temperature array sensor can be beneficial in low to no flow conditions, as the temperature array sensor may lose accuracy in no flow conditions but will act as confirmation data for the microphone.

FIG. 4 shows the same system components and arrangement as FIG. 3 during low flow conditions 12. FIG. 5 shows the same system components and arrangement as FIGS. 3 and 4, but during no flow conditions 10. These flow conditions may trigger specific pre-programmed conditions in the data gathering and analyzing unit 2 (FIG. 1).

Figure 6:
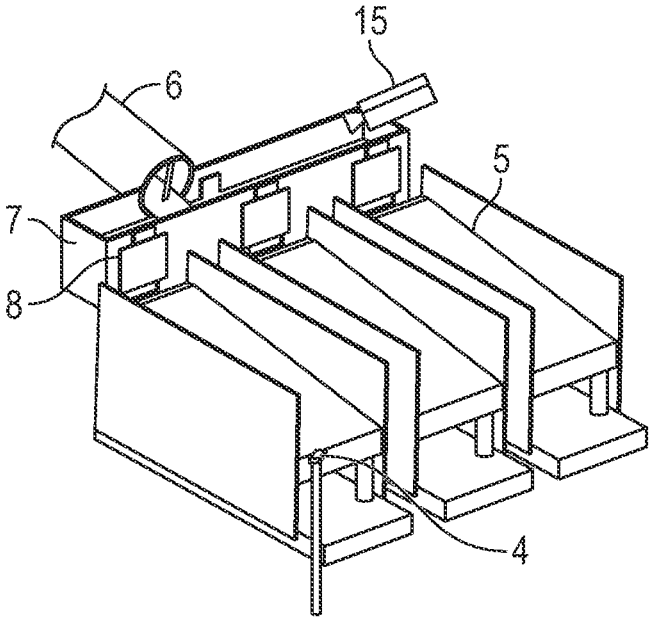
FIG. 6 shows a close view of certain features of a system for monitoring fluid flow conditions, the system including shakers, during standard drilling flow in accordance with one or more embodiments.

FIG. 6 shows system components and arrangement of a system 1 (FIG. 1) for monitoring fluid flow during standard flow conditions in accordance with one or more embodiments of the present application. As shown, the system 1 (FIG. 1) may include an area sensor 4 coupled to the header box 7. The area sensor 4 is a sensor configured to identify maintenance conditions in the area near the system. The area sensor 4 is configured to sense when personnel are nearby the system. The area sensor 4 may send a receiving signal to the data gathering and analyzing unit 2 (FIG. 1). The system assumes any personnel in the area implies a maintenance status. The data gathering and analyzing unit 2 (FIG. 1) processes the receiving signal from the area sensor 4 to determine if maintenance conditions are identified. If flow rate data communicated by the flow sensors indicate flow rate values of the fluid exiting the return flow line 6 into the header box 7 are different than an expected flow rate and the area sensor 4 indicates maintenance is occurring by sensing motion in the area simultaneously, then the data gathering and analyzing unit 2 (FIG. 1) bypasses any alarms it would have triggered due to the values of the flow rate data. This bypass of alarms may ensure that alarms do not trigger when process changes are caused by system maintenance rather than a process upset.

The data gathering and analyzing unit 2 (FIG. 1) is pre-programmed with different common detectable conditions in order to recognize a current operational status, a hazardous operational status, a self-cleaning status, or a maintenance status based on one or more flow sensors 10, 15, the area sensor 4, the self-cleaning device 29, and the mud pump 16. Table 1 shows a table of examples of pre-programmed conditions in the data gathering and analyzing unit 2 (FIG. 1) related to the flow sensor 15, 10 and mud pump 16 speed information. However, one of ordinary skill in the art will appreciate that other pre-programmed conditions may be input into the data gathering and analyzing unit 2 (FIG. 1) for comparing against data received from one or more sensors of the system for monitoring fluid flow based on, for example, a particular application, equipment configuration of a site, expected flow conditions, expected maintenance, expected cleaning operations, etc. Historical data may also be input into the data gathering and analyzing unit 2 (FIG. 1) and may include information on fluid flow rate and pump speed specific to certain system conditions.

TABLE 1

Examples of pre-programmed conditions in the data gathering and analyzing unit based on mud pump speed and flow sensor readings.

| Condition | Pump Speed | Flow Rate |
|---|---|---|
| Standard Drilling | Constant Rate | Constant Rate |
| Potential Loss Zone Present | Constant Rate | Lower flow rate relative to historical values |
| Expected Influx | Constant Rate | Higher flow rate relative to historical values |

TABLE 1-continued

Examples of pre-programmed conditions in the data gathering and analyzing unit based on mud pump speed and flow sensor readings.

| Condition | Pump Speed | Flow Rate |
|---|---|---|
| Drilling and making a connection (beginning) with good drilling conditions | Pumps slowly reduced down from standard constant rate to 0 | Flow rate slowly decreases from standard constant rate to 0 |
| Drilling and making a connection (beginning) with good drilling conditions | Pumps slowly reduced down from standard constant rate to 0 | Small flow rate might be noticeable if the pipe moves upward and downward |
| Drilling and making a connection (beginning) with potential well ballooning | Pumps slowly reduced down from standard constant rate to 0 | Flow rate reduced to minimal and stays at minimal before returning to 0 |
| Drilling and making a connection (beginning) with potential influx | Pumps slowly reduced down from standard constant rate to 0 | Flow reduced to minimal without reaching 0, with a minimal flow potentially returning after 0 flow temporarily during connection |
| Drilling and making a connection (finishing) with good drilling conditions | Slowly starting from 0 to standard constant rate | Small and constant time delay to measure flow rate at the sensor between each connection |
| Drilling and making a connection (finishing) with potential losses | Slowly starting from 0 to standard constant rate | Time delay higher than historical values, flow rate lower relative to historical values. In total loss scenarios, the flow will remain at 0. |
| Drilling and making a connection (finishing) with potential influx | Slowly starting from 0 to standard constant rate | Time delay lower than historical values, flow rate increasing relative to historical values |
| Tripping in and out of hole with potential losses | Slowly starting from 0 to standard constant rate | Time delay higher than historical values, lower flow rate relative to historical values |
| Tripping in and out of hole with potential influx | Slowly starting from 0 to standard constant rate | Time delay lower than historical values, higher flow rate relative to historical values |
| Tripping out of the hole with pumps off with potential influx | Pumps slowly reduced down from standard constant rate to 0 | Time delay lower than historical values, higher flow rate relative to historical values |
| Tripping in the hole with pumps off with potential losses | Pumps are at 0 (off) | Lower or no flow rate relative to historical values |
| Tripping in the hole with pumps off with potential influx | Pumps are at 0 (off) (off) | Higher flow rate relative to historical values and higher flow rate |

When the data gathering and analyzing unit 2 (FIG. 1) recognizes a pre-programmed condition, the data gathering and analyzing unit 2 (FIG. 1) may send that information to the control panel 3 (FIG. 1). If the pre-programmed condition is a hazardous operational status, an auditory and/or visual notification may occur in the form of a sound and/or a light. In some embodiments, additional pre-programmed conditions and machine learning may be utilized to optimize the system functionality.

Figure 8:
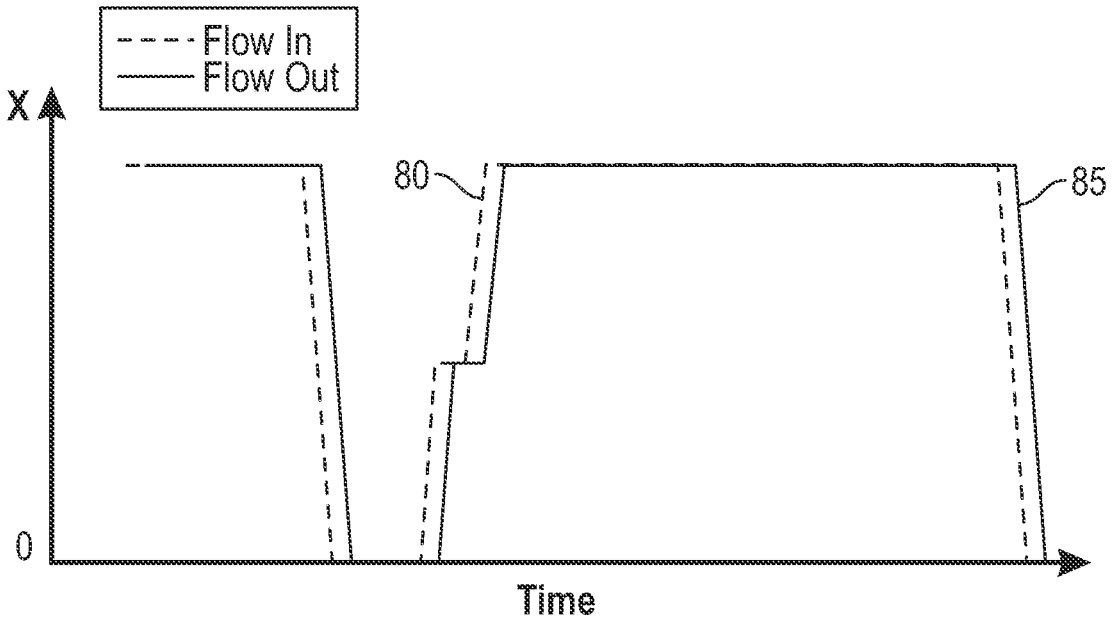
FIG. 8 shows a graph of standard drilling activities in accordance with one or more embodiments.
Figure 9:
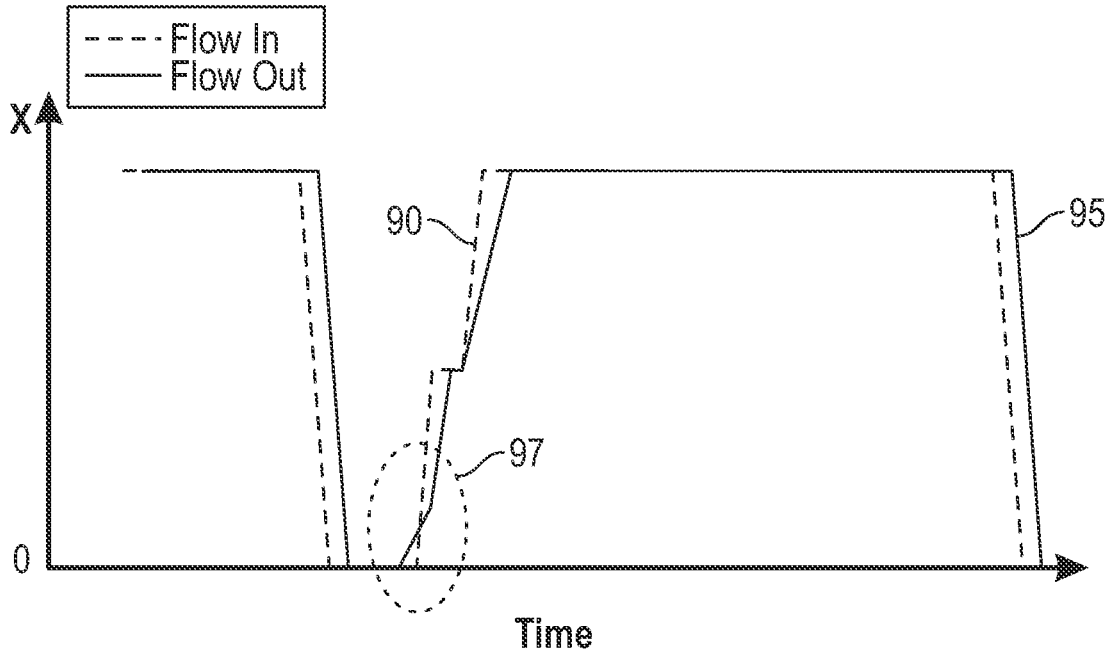
FIG. 9 shows a graphical representation of a potential influx in accordance with one or more embodiments.
Figure 10:
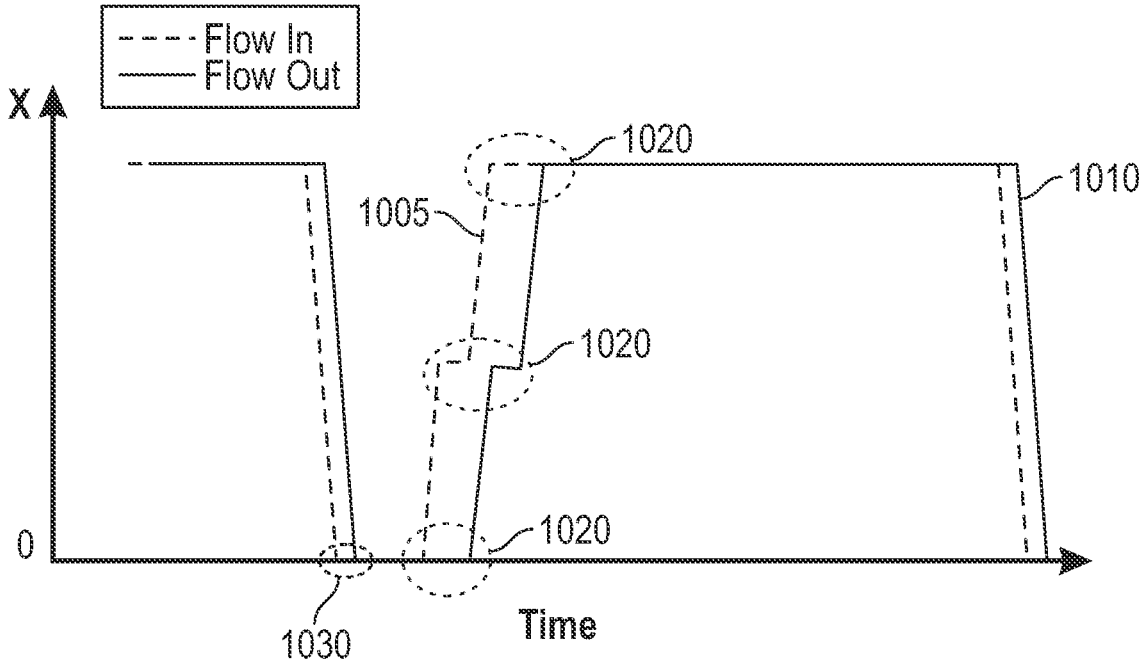
FIG. 10 shows a graphical representation of a potential loss zone in accordance with one or more embodiments.

FIGS. 8-10 demonstrate data representations of different drilling conditions with lines indicating flow in and flow out. The flow out is the flow rate data obtained by the system in the return flow line. The flow in is the flow rate data obtained by the system from the flow pumped into the well by measuring strokes of the pump and displacement volume. This information may be displayed on the control panel (FIG. 1, 3). The system interprets this data as shown in Table 1 above. In FIG. 8, standard drilling conditions are shown with a line for the flow in 80 and a line for flow out 85 that are identical with a time delay. A time delay refers to the delay in the flow rate out compared to the flow rate in when tracking flow rate against time. The time delay occurs at the start of the circulation of the mud, as initially mud goes through the inlet but does not reach the return flow line flow sensors (e.g. sensors 10, 15 in FIGS. 1, 3-6) until the mud has traveled into the wellbore, up the wellbore annulus 18 (FIG. 1), and through the return flow line 6 (FIG. 1).

FIG. 8 represents a closed system, where the flow should remain steady throughout the system 1 (FIG. 1) in standard conditions. In FIG. 9, the flow in 90 follows a similar path to FIG. 8; however, the flow out 95 indicates that an influx may occur as the flow rate out appears to increase rapidly and earlier than expected 97. In FIG. 10, the flow in 1005 follows a similar path to FIGS. 8 and 9; however, there is an uneven lag 1030 between the flow in 1005 and the flow out 1010 and a non-parallel relationship 1020 between the flow in and flow out when the flow is restarted, suggesting that there may be a potential loss zone present.

Embodiments of the present disclosure may provide at least one of the following advantages. Initiating auditory and visual notifications based on the fluid flow rate of the return flow line 6 (FIG. 1) and the pump speed provides a leading indicator to identify problems before significant damages have occurred, including influxes, fluid losses, well ballooning, or even blow outs. These auditory and visual notifications may allow the system 1 (FIG. 1) to be adjusted, and even shut down, when required. This early detection may prevent equipment damage, costly fluid losses, and unsafe working conditions for individuals operating the equipment. Early detection is crucial; however, it may provide an opportunity for unnecessary process interruptions because of outside causes for system variations, such as maintenance and self-cleaning activities. The area sensor 4 (FIG. 1) and self-cleaning device 29 (FIG. 1) in one or more embodiments of the system account for maintenance and self-cleaning issues and bypass alarms to prevent these potential unnecessary, and costly, process interruptions.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed:

1. A system for monitoring fluid flow conditions on a return flow line, comprising:

a return flow line in fluid communication with a wellbore;

a shaker having one or more screens configured to filter a fluid;

a header box coupled to the shaker and in fluid communication with the return flow line;

a contactless flow sensor, comprising a camera, facing an interior of the header box or an outlet of the return flow line proximate the header box and configured to determine a fluid flow rate based on a fluid level in the header box, the return flow line, or both;

a data gathering and analyzing unit operatively coupled to the contactless flow sensor, wherein the data gathering and analyzing unit determines a current operational status or a hazardous operational status based on the fluid flow rate and a mud pump speed;

a dye sprayer coupled to the header box and directed towards an interior of the header box, wherein the dye sprayer sprays a dye on the fluid in the header box to improve camera visibility of a mud level for the contactless flow sensor; and a control panel operatively coupled to the data gathering and analyzing unit, wherein the control panel comprises:

a human machine interface (HMI) configured to display the fluid flow rate, the mud pump speed, and the current operational status or the hazardous operational status; and one or more notification instruments configured to activate based on the hazardous operational status.

2. The system of claim 1, further comprising a contact flow sensor located in the return flow line or the header box, wherein the contact flow sensor is physically marked with a reference guide to provide a reference point to the contactless flow sensors.

3. The system of claim 2, wherein the contact flow sensor is operatively coupled to the data gathering and analyzing unit.

4. The system of claim 1, further comprising an area sensor disposed proximate the shaker and configured to monitor maintenance activity proximate the shaker to indicate a maintenance status for the system.

5. The system of claim 1, wherein the contactless flow sensor further comprises a self-cleaning device, wherein the self-cleaning device sprays a fluid onto the contactless flow sensor and is configured to communicate a self-cleaning status of the system.

6. The system of claim 1, wherein the contactless flow sensor further comprises a visible light source, an infrared light source, or both.

7. The system of claim 2, wherein the contactless flow sensor and the contact flow sensor are wired, wireless, or both.

8. The system of claim 1, further comprising a plurality of flow gates coupled to the shaker configured to control flow between the header box and the shaker.

9. The system of claim 1, wherein the one or more notification instruments in the control panel are auditory, visual, or both.

10. A process for monitoring fluid flow conditions comprising:

flowing a drilling mud into a header box via a return flow line;

monitoring a height of the drilling mud in the header box, the return flow line, or both, the monitoring comprising spraying dye using a dye sprayer on the drilling mud to improve visibility of a fluid level and determining a fluid level in the header box, the return flow line, or both using a contactless flow sensor facing an interior of the header box or an outlet of the return flow line proximate the header box; and determining a current operational status or a hazardous operational status, the determining the current operational status or a hazardous operational status comprising calculating a fluid flow rate based on the determining the fluid level in the header box, the return flow line, or both, using a data gathering and analyzing unit operatively coupled to one or more contactless flow sensors.

11. The process of claim 10, further comprising providing a contact flow sensor located in at least one of the return flow line or the header box, wherein the contact flow sensor is physically marked to provide a known height to the contactless flow sensor.

12. The process of claim 11, further comprising sending a signal from the contact flow sensor to the data gathering and analyzing unit.

13. The process of claim 10, further comprising receiving signals from the contactless flow sensor by a control panel operatively coupled to a data gathering and analyzing unit.

14. The process of claim 13, further comprising receiving signals from an area sensor by the control panel operatively coupled to the data gathering and analyzing unit to determine a maintenance status.

15. The process of claim 14, further comprising displaying flow rate information and the current operational status or the maintenance status using a human machine interface (HMI) based on the receiving signals from the contactless flow sensor and the receiving signals from the area sensor.

16. The process of claim 13, further comprising receiving signals from a self-cleaning device by the control panel operatively coupled to the data gathering and analyzing unit to determine a self-cleaning status.

17. The process of claim 16, further comprising displaying flow rate information and the current operational status or self-cleaning status using a human machine interface (HMI) based on the receiving signals from the contactless flow sensor and the receiving signals from the self-cleaning device.

18. The process of claim 13, further comprising activating light using a visual notification instrument based on the hazardous operational status.

19. The process of claim 13, further comprising activating an alarm using an auditory notification instrument based on the hazardous operational status.

* * * * *